United States Patent [19]

Goto et al.

[11] Patent Number: 4,698,622

[45] Date of Patent: Oct. 6, 1987

[54] BRAKE APPARATUS FOR AUTOMATIC DOOR

[75] Inventors: Teruo Goto, Osaka; Yoshirou Takata, Otsu; Kenji Muraji, Osaka; Mikio Higashi, Kyoto, all of Japan

[73] Assignee: Daihatsu Diesel Mfg. Co., Ltd., Osaka, Japan

[21] Appl. No.: 722,069

[22] Filed: Apr. 10, 1985

[30] Foreign Application Priority Data

Apr. 16, 1984 [JP] Japan ..... 59-77432
Jun. 25, 1984 [JP] Japan ..... 59-95768[U]
Aug. 31, 1984 [JP] Japan ..... 59-183147

[51] Int. Cl.[4] ..... G08B 21/00

[52] U.S. Cl. ..... 340/648; 318/261; 318/266; 318/265

[58] Field of Search ..... 187/29 R; 318/269, 266, 318/603, 261, 265; 340/648

[56] References Cited

U.S. PATENT DOCUMENTS 4,145,641 3/1979 Ozaki ..... 318/269
4,203,058 5/1980 Chen ..... 340/648
4,401,929 8/1983 Odaka et al. ..... 318/266
4,429,264 1/1984 Richmond ..... 318/266 X
4,449,078 5/1984 Ogishi et al. ..... 318/603
4,498,033 2/1985 Aihara et al. ..... 318/266 X
4,563,625 1/1986 Kornbrekke et al. ..... 318/603

*Primary Examiner*—Glen R. Swann, III
*Assistant Examiner*—Jeffery A. Hofsass
*Attorney, Agent, or Firm*—Koda and Androlia

[57] ABSTRACT

A brake apparatus for automatic doors including a speed pulse signal output device for providing speed pulse signals at a time interval inversely proportional to the door speed of an automatic door, a brake for slowing the door speed, a braking position detector for detecting braking position when the brake starts braking, a brake effect measurer for measuring the effect of the brake and a braking power controller for adjusting the braking power of the brake in accordance with the measured braking effect whereby the motion of the door is kept constant irrespective of the door weight and other conditions.

2 Claims, 23 Drawing Figures

FIG. 10 ( e )
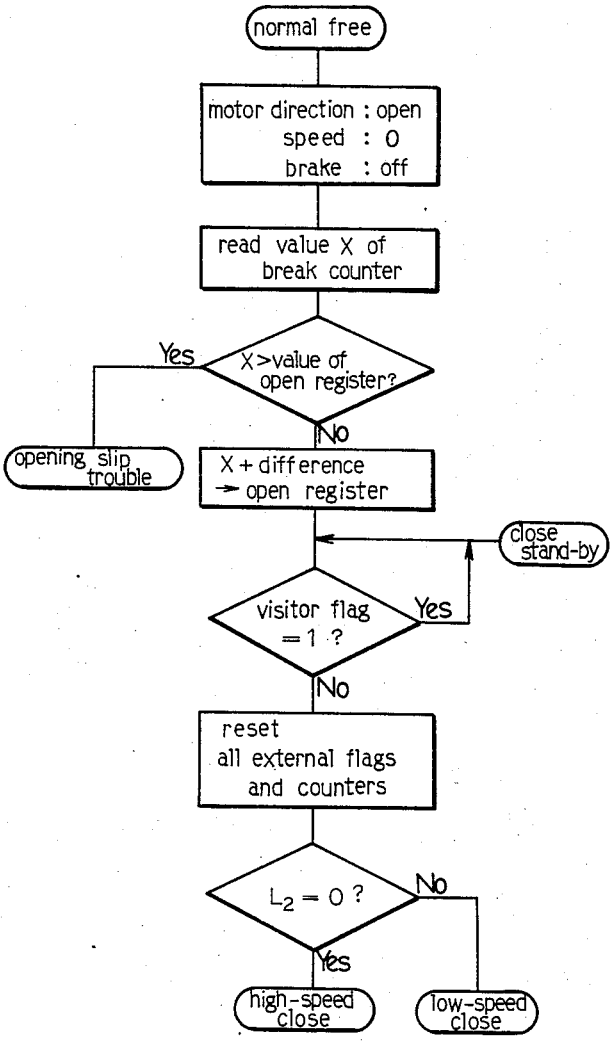
FIG. 10 ( f )
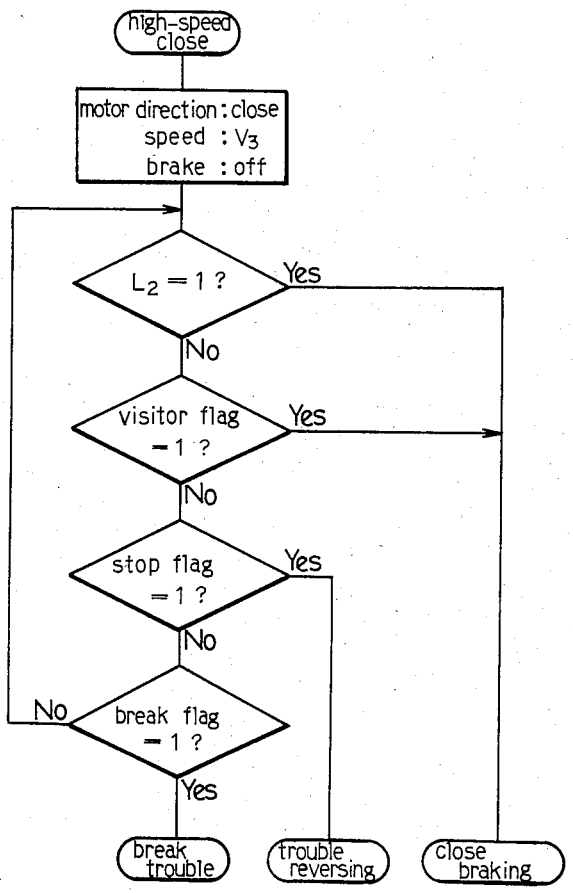

FIG. 10( i )
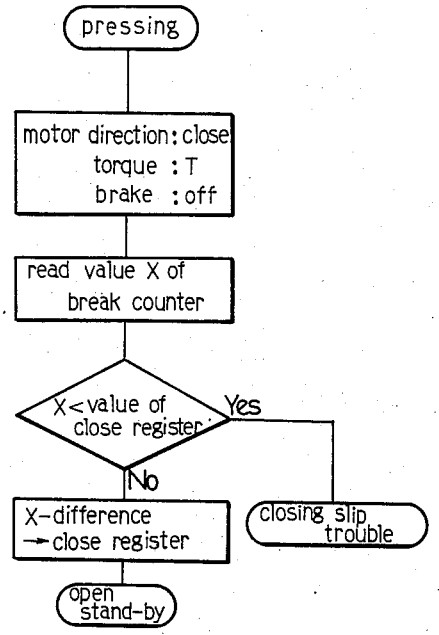
FIG 10 ( j )
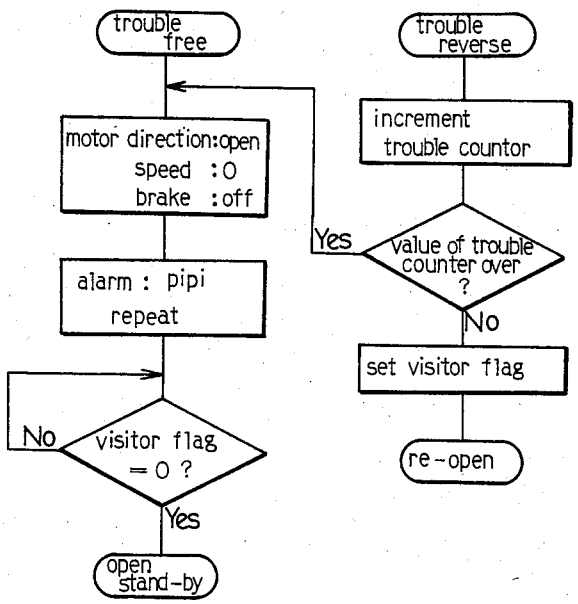

FIG.10(ℓ)

BRAKE APPARATUS FOR AUTOMATIC DOOR

BACKGROUND OF THE INVENTION

1. Field of the Invention

This invention relates to a break apparatus for automatic door, more particularly the brake apparatus to ensure safe and smooth closing motion of automatic door.

2. Description of the Prior Art

An automatic door is generally operated in three basic steps; transfer of the door driven by a motor to the predetermined position a little before full open or full shut position at comparatively high speed, deceleration by operating the braking means at least for once, and transfer to full open or full shut position at comparatively low speed.

Such braking means in three step operation is disclosed, for example, in Official Gazette of Japanese Unexamined Patent Publication No. Sho 58-80082.

It is necessary, however, to adjust braking power of the braking means adequately for the door of different weight or where automatic door is installed in different conditions. If not, the motion may not be smooth in some cases.

If a door is heavier than the weight suitable to certain braking power of the braking means, for example, the door speed can't be lowered sufficiently and the door is to be bumped at closing. If a door is too light, on the other hand, the door speed is lowered sharply and it takes too long time before the door is closed completely.

If operation of the braking means go out of order, the deceleration of the three steps fails and the door speed changes abruptly from high-speed to low speed or reaches the full open or full shut position while keeping high-speed, which applies impact to the door mechanism and may possibly affect the components other than the braking means.

It is desirable, therefore, to find defect of the braking means earlier.

Conventional automatic door, however, are not provided with any device to detect the defect of the braking means and the detection by persons tends to be delayed.

SUMMARY OF THE INVENTION

An object of the present invention is to provide a brake apparatus for automatic door which automatically adjust the braking power of the braking means so as to maintain smooth motion of the door at all times.

Another object of the invention is to provide a brake apparatus for automatic door which can detect and inform the defect of the braking means.

With the above objects in view, the present invention is to provide a brake apparatus for automatic door comprising speed pulse signal output means to transmit speed pulse signals at time intervals inversely proportional to door speed, braking means for door deceleration, braking position detect means to detect the position where said braking means are operated, brake effect measuring means to measure effect of said braking means, and braking power control means to adjust magnitude of braking power of the braking means based on the measured braking effect.

The present invention also provides a brake apparatus for automatic door comprising speed pulse signal output means to transmit speed pulse signals at time intervals inversely proportional to door speed, braking means for door deceleration, braking position detect means to detect the position where said braking means are operated, brake effect measuring means to measure effect of said braking means, brake defective signal output means to detect mal-function of the braking means based on the measured braking effect and to give output of brake defective signal, and alarm means to transmit alarm when output of said brake defective signal is given.

DETAILED DESCRIPTION OF THE PREFERRED EMBODIMENTS

Figure 1:
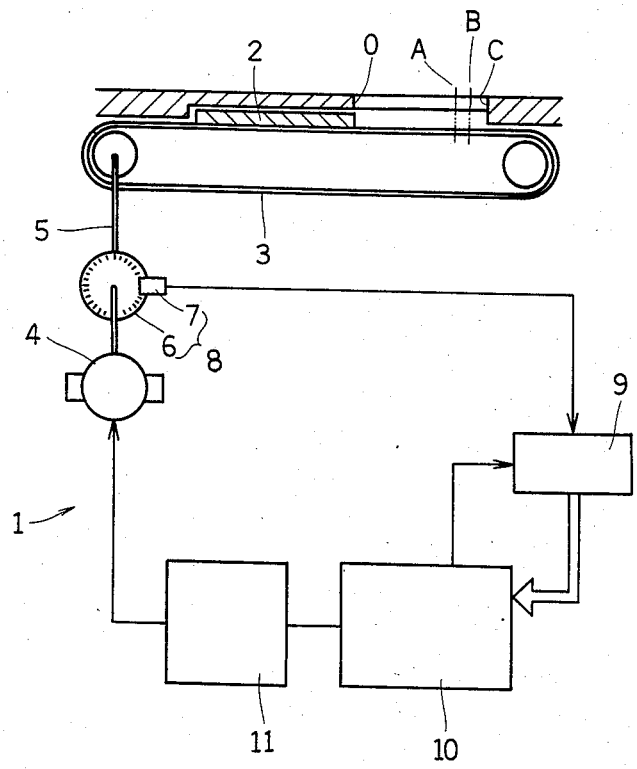
FIG. 1 is a descriptive drawing of an automatic door including a brake apparatus as an embodiment of the present invention.

FIG. 1 shows an automatic door 1, in which a door 2 is fixed to a belt 3 and is moved by a motor 4 through the belt 3.

A slit disk 6 is attached to the shaft 5 of the motor 4 and a number of slits on the slit disk 6 are detected by a photo-sensor 7 for output of pulse signals. Thus the speed pulse signal output is given at a time interval inversely proportional to the transfer speed of the door 2. The speed pulse signal output means is composed of the slit disk 6 and the photo-sensor 7.

Besides, the speed pulse signal output means may also be composed for example, so that pulse signal output is given by detecting the teeth of gears turned by transfer to the door, through magnetic or photoelectric means. It may also be composed of pulse output mechanism synchronized with revolution of the motor which drives the door. Other known means may also be used to compose the speed pulse signal output means. In short, it may comprises means by which output of more number of pulses is given as the door speed increases.

Pulse waveform is not limited so long as it is countable.

The output of speed pulse signals from the speed pulse signal output means 8 goes into the counter 9 to be counted. The counter 9 is cleared by the clear signal from the computer 10. This counter 9 comprises the pulse number detecting means.

Instead of the digital arrangement of the counter circuit as shown above, number of pulse signals can also be counted by analog circuit arrangement such as an integrating circuit. Moreover, instead of such hardware means, software means such as a computer program may also be used for pulse signal counting.

The computer 10 controls operation of the motor 4 through the motor control circuit 11 for open-shut operation of the door 2 and also performs braking by dynamic braking by the motor 4.

As the braking means, conventional and known type used in this field is also applicable.

For changing the braking power of the braking means, duty ratio to operate the braking means may be changed, for example.

Now follows description of normal operation of the computer 10 while taking closing motion of the door 2 as an example.

Figure 2:
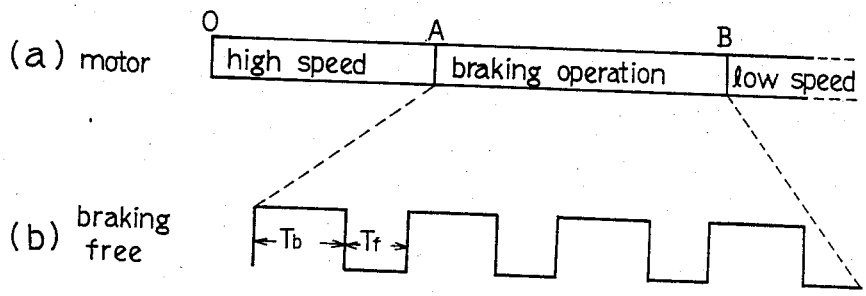
FIG. 2 is a time chart of motor operation and brake operation.

First, the motor 4 is turned at comparatively high-speed to shut the door 2 rather quickly. When reaching to the predetermined braking position A is detected by the count on the counter 9, the motor 4 is operated to dynamic braking mode for the predetermined braking time (Tb) only, as shown in FIG. 2(*b*), then operated to free turning mode for the predetermined free time (Tf) only, and the two modes are repeated alternatively. Lowering of door speed to a comparatively low level is detected by the counting rate on the counter 9, then the motor 4 is turned at comparatively low speed from the position B to shut the door 2 completely at comparatively low speed.

The computer 10 is the braking power select means to select adequate braking power through selection of braking duty ratio i.e. Tb/(Tb+Tf).

When power switch is closed or operator's instruction is given, the door 2 is closed at comparatively low speed to full shut. The low speed is to prevent bumping of the door against the door stop when stroke or the current position of the door 2 is unknown. Full shut or not is known by no change of the count on the counter 9.

After the output of clear signal pulse to clear the counter 9, the door 2 is opened rather slowly to full open. The count on the counter 9 at this time indicates the stroke of the door 2. The distance corresponding to one count on the counter 9 is determined by the dimensions of the slit disk 6. Accordingly, the computer 10 can recognize the relation between the count and the door position exactly.

As an example, take one count is equal to 2 mm and the count is "1000" for convenience of explanation. Under this condition, stroke of the door 2 is 2 m.

Then the computer 10 functions to set the pulse signal number to start the operation of the braking means. If, for example, the start position of the braking means is preliminary instructed to be 200 mm before full shut, the value held on the counter 9 at full open position plus "900" is set as the pulse signal number.

The pulse signal number, however, is not limited to this setting way but may be set freely corresponding to a desired position within the range from the position that the door can reach comparatively high-speed at closing motion to the predetermined distance before full shut.

Then the door 2 is closed at comparatively high-speed and braking is applied when the count on the counter 9 reaches the preset number of pulse signal. Braking power can be selected as a duty ratio described above. If five steps of duty ratio 15, 12, 8, 6, and 2 are available for selection, for example, the duty ratio is set at 15 in this case. In other words, braking is applied at the maximum braking power. The highest braking power should be in the magnitude that the heaviest door expectable can be stopped at the predetermined position before full shut.

When stopping of the door 2 is detected through no change of the count on the counter 9, the counter 9 is cleared by the output of clear signal pulse. Then the door 2 is closed at comparatively low speed to full shut. The count on the counter 9 at this time corresponds to the distance of closing motion at comparatively low speed. From other point of view, it also corresponds to the distance remained by subtracting the braking distance from the distance of 200 mm position before full shut, which indirectly corresponds to the braking distance.

Besides, the number of pulse signals from operation of the braking means to stopping of the door corresponds directly to the door braking distance. It may also be possible, however, to measure the speed pulse signal which indirectly corresponds to the braking distance as mentioned above.

Figure 3:
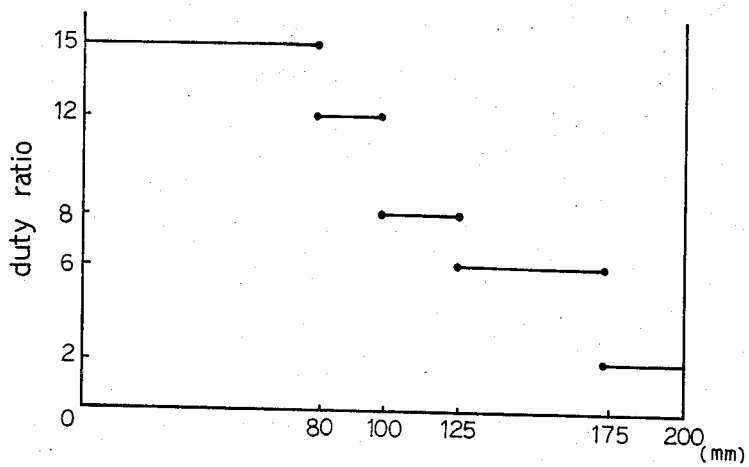
FIG. 3 is a descriptive drawing of braking power selection standard.

The computer 10 selects the duty ratio for the next operation according to the count on the counter 9 obtained during the closing operation of comparatively low speed at this time. If the count is "55" and the selection standard shown in FIG. 3 is memorized in the memory as a table, for example, the count "55" corresponds to 110 mm and duty ratio of 8 is selected.

Thus, the next braking is applied at duty ratio of 8. Since the braking power is smaller than that of duty ratio 15, the braking distance becomes longer and the distance of closing at comparatively low speed becomes shorter on the contrary.

If the door 2 is less heavier, the braking effect is larger provided that the braking power is constant, and the door 2 comes to a stop faster. Accordingly, the above count becomes larger. As shown in FIG. 3, however, the duty ratio becomes smaller as the counter gets larger. Accordingly, the braking power becomes lower and the braking effect of the next time is smaller.

Because of the correction of braking force corresponding to door weight in this manner, the braking distance is kept approximately constant, after all with no regard to door weight.

In this automatic door 1, smooth operation of the door 2 is secured by self-correction of braking power as described above irrespective of door weight and other conditions.

As modified embodiment, it is also possible to preset an adequate reference range and to select higher braking power if the braking distance is larger than the reference range, to maintain present braking power if the braking distance is within the reference range, and to select lower braking power if the braking distance is shorter than the reference range.

Figure 4:
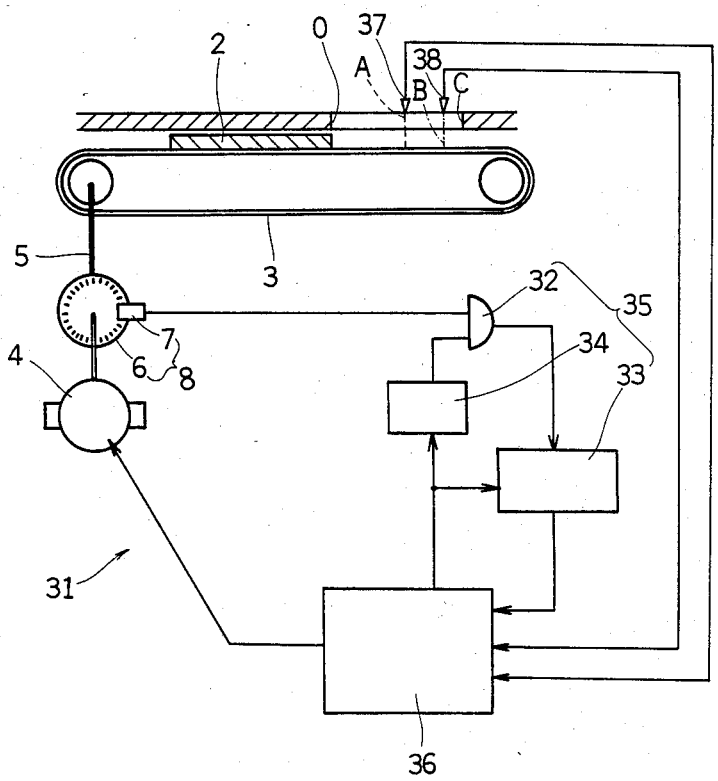
FIG. 4 is a descriptive drawing of an automatic door including a brake apparatus as another embodiment of the present invention.

The automatic door 31 shown in FIG. 4 includes another embodiment of the invention. Of the components, the door 2, belt 3, motor 4, rotary shaft 5, slit disk 6, photo-sensor 7, and speed pulse signal output means 8 are similar to those of the above automatic door 1 and, therefore, are numbered with the same reference numbers.

The output of speed pulse signal from the speed pulse signal output means 8 goes into the counter 33 through the gate 32 to be counted. The gate 32 is opened during the period from the time when the time is turned to ON by the start signal from the computer 36 to the time when the timer 34 returns to OFF after predetermined time. While the counter 33 is cleared by the above mentioned start signal. The count on the counter 33, therefore, is equal to the number of pulse signals during the predetermined time after output of start signal from the computer 36.

The gate 32, counter 33 and timer 34 comprise the pulse number detecting means.

The computer 36 is the means for controlling open-shut operation of the door 2 by controlling the motor 4 and the means for braking to apply dynamic braking of the motor 4.

Figure 5:
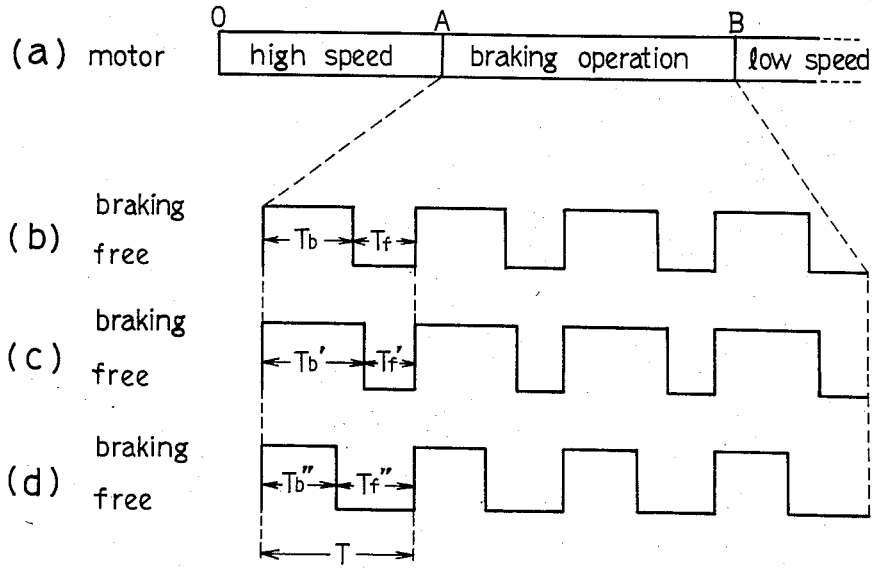
FIG. 5 is a time chart of motor operation and brake operation.

Taking closing motion of the door 2, for example, the motor 4 is first turned at comparatively high-speed to shut the door 2 rather quickly. When the end of the door 2 is detected by the 1st door position sensor 37, the motor 4 is turned to dynamic braking mode for the braking time (Tb) only as shown in FIG. 5(*b*), then is turned to free revolution mode for the predetermined free time (Tf), and the modes are repeated alternatively. When the end of the door 2 is detected by the 2nd door position sensor 38, the motor 4 is turned at comparately low speed to shut the door 2 completely at low-speed.

The computer 36 gives output of start signal to the counter 33 and the timer 34 when the end of the door 2 is detected by the 1st door position sensor 37.

Figure 6:
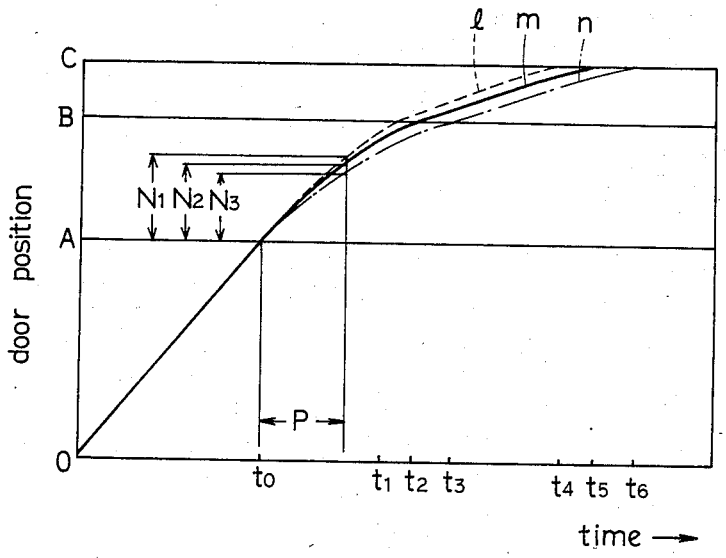
FIG. 6 is a characteristic diagram of door motion.

FIG. 6 shows transfer characteristics of an over weighted door, adequate weight door, and under weighted door respectively by characteristic curve l, m, and n, when braking duty ration (Tb/(Tb+Tf)) is taken constant.

In the section O - A of the vertical axis of FIG. 6, the door 2 is closed at comparatively high-speed. Since the motor 4 is controlled by the computer 36 to a fixed rate of revolution at this time, the speed i.e. the gradient of the curve is constant with no regard to door weight, and the time $t_o$ for the door 2 to reach the 1st door position sensor 37 is constant.

Section A-B is for braking where the door 2 is subjected to braking intermittently. Since the braking effect is lower with heavier door, a heavy door is not decelerated sufficiently and reaches the 2nd door position sensor 38 within a short time. While a light door is decelerated quickly and takes a long time before reaching the 2nd door position sensor 38. Accordingly, the time to reach the 2nd door position sensor 38 is in the order of t1, t2, t3 becoming longer for heavier doors.

In section B - C, the door 2 is closed at comparatively low speed. Since the motor 4 is controlled by the computer 36 to certain rate of revolution, the speed, i.e. the gradient of the curve is constanted with no regard to door weight, and the required time for this section is also constant. Accordingly, the time for the door to full shut, t4, t5, t6, are in the same order as the time t1, t2, and t3.

As the discontinuous property of the gradient of the characteristic curve l at time t1 indicates, transfer from the braking section to the low-speed section is not smooth with over-weighted doors. While with under-weighted doors, the time to full shut of the door is too long as indicated by the fact that the time t6 comes the last on the characteristic curve n. With characteristic curve m, on the other hand, transfer is smooth, and the time to full shut of the door is not long.

If the period while the gate 32 is opened by the timer 34 is P as shown in FIG. 6, the number of pulse K1 during the time of transfer by distance N1 shown in FIG. 6 is to be counted by the counter 33 with over-weighted doors. With doors of an adequate weight, the number of pulse K2 during the transfer distance N2 is counted, and with under-weighted doors, the number of pulse K3 during the transfer distance N3 is to be counted.

As described above, output of pulse signal is given at the time interval inversely proportional to door speed. The count, therefore, indicates door transfer distance, after all. Accordingly, the relationship of K1>K2>K3 is established.

With input of preliminary setting of value D, the computer 36 compares the count K on the counter 33 with the value D at the end of each closing motion. If K>D, the value of Tb/(Tb+Tf) is increased a little and if K<D, the value is decreased slightly.

If the setting value D is equal to K2 and the count K1 is obtained, it is the case of K>D. Accordingly, the braking time Tb is extended a little and free time Tf is shorted slightly so that the total time Tb+Tf is kept unchanged, thus the duty ratio of Tb/(Tb+Tf) is increased a little. FIG. 5(*c*) shows this arrangement and the extended braking time and the shortened free time are respectively indicated by Tb' and Tf'. Since the closing operation of the next time is braked with this slightly increased duty ratio, the braking effect is intensified a little and the obtained count is closer to K2.

When the count K3 is obtained, on the other hand, K3 is smaller than D. Accordingly, the braking time Tb is shortened a little and the free time Tf is extended. FIG. 5(*d*) shows this and the shortened braking time and extended free time are respectively indicated by Tb'' and Tf''. The braking effect is slightly lowered and the obtained count is closer to K2.

As shown above, the computer 36 automatically controls the duty ratio of braking at every closing operation and the count K is adjusted closer to the setting value D. Accordingly, the door 2 can perform the specified smooth operation, such as shown by the performance curve m in FIG. 6 for example, after closing operations of several times and with no regard to door weight and other conditions.

In the above embodiment, the duty ratio is controlled by software arrangement by the computer. Hardware arrangement also possible by using such as comparator and so on.

After all, any arrangement is possible if it functions to operate the braking means intermittently by increasing the duty ratio when the number of pulse signals detected during the braking operation at certain duty ratio is higher than the predetermined value and by decreasing the duty ratio if it is lower than the predetermined value.

Figure 7:
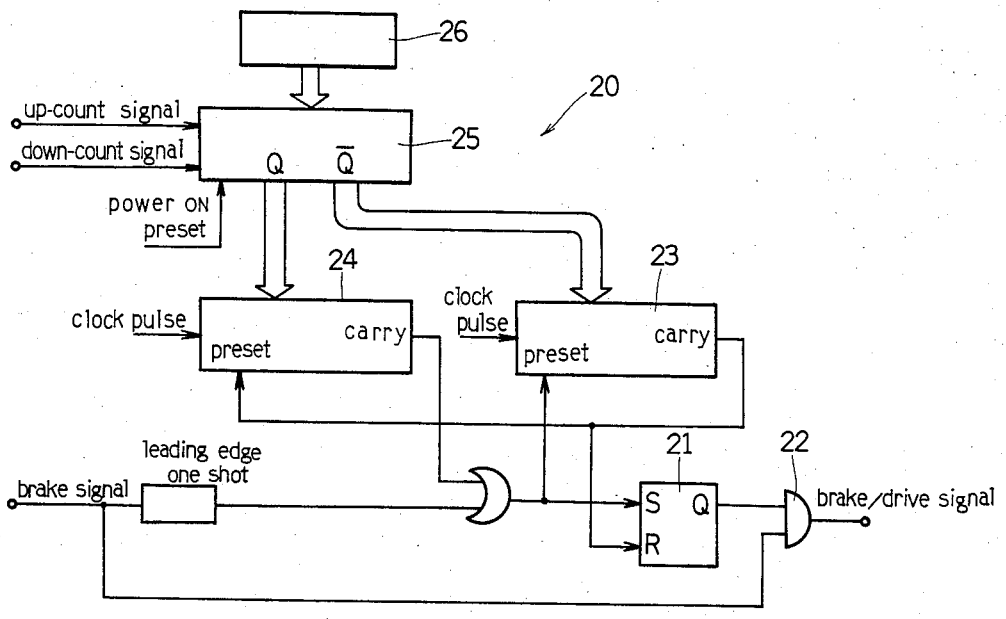
FIG. 7 is a circuit deagram of an example of duty ratio control circuit.

FIG. 7 is an example of duty ratio adjusting means composed of hardware circuits, which can reduce the work of the microcomputer 36 when installed between the microcomputer 36 and the motor 4.

When brake signal input is given to the duty ratio adjusting means 20, the flip-flop 21 is set by leading edge of the brake signal, and the brake drive signal to the braking means is turned to ON through the AND gate 22.

By leading edge of the brake signal, inverted output of the time setting counter 25 is set onto the ON time counter 23. The ON time counter 23 outputs carry signal, when the clock pulse is counted to the retained value on the time setting counter 25, and the carry signal resets the flip-flop 21. Then the brake drive signal is turned to OFF.

Since the carry signal of the ON time counter 23 sets the non-inverted output of the time setting counter 25 onto the OFF time counter 24, carry output is given by the OFF time counter 24 when the clock is counted by the complement of the retained number on the time setting counter 25, the flip-flop 21 is set again, and inverted output of the time setting counter 25 is set onto the ON time counter 23 again.

The same operation is repeated further for output of brake/drive signal of pulse form.

The ON time of brake/drive signal is Tb time in FIG. 5 and corresponds to the retained value on the time setting counter 25. The OFF time of brake/drive signal is Tf time in FIG. 5 and corresponds to the value remaining by subtracting the retained value from full counter on the time setting counter 25 (i.e. the above mentioned complement). If the retained number on the time setting counter 25 is increased by input of up-count signal, the ON time is extended and OFF time is shortened on the contrary. In other words, the duty ratio is increased. If the retained number on the time setting counter 25 is decreased by input of down-count signal, ON time is shortened and OFF time is extended. The duty ratio is lowered.

The microcomputer 36 shown in FIG. 4, for example, can adjust duty ratio by output of brake signal, up-count signal and down-count signal to such circuit 20.

At power ON, the value set onto the initial setting switch 26 is set onto the time setting counter 25.

In another embodiment of the invention, the duty ratio may adjust more than once in one closing operation.

Another embodiment comprises means to judge door position from the humber of speed pulse signals like the above described automatic door 1, so as to eliminate the door position sensor.

It may also possible to detect the number of pulses at a certain time from the start of closing the door stopped at full open position and to adjust automatically the duty ratio of braking based on the detected number of pulses. In this case, the count of pulse is less with heavier door because of the inertia.

Control of the above brake apparatus is applicable to braking of the automatic door in opening operation. It is also possible, without saying, to apply the duty ratio obtained for closing operation to the next opening operation or vice versa.

As described above, the desired smooth door motion is ensured at all times for this automatic door 31 because operation of the braking means is adjusted automatically according to changes in the conditions.

Figure 8:
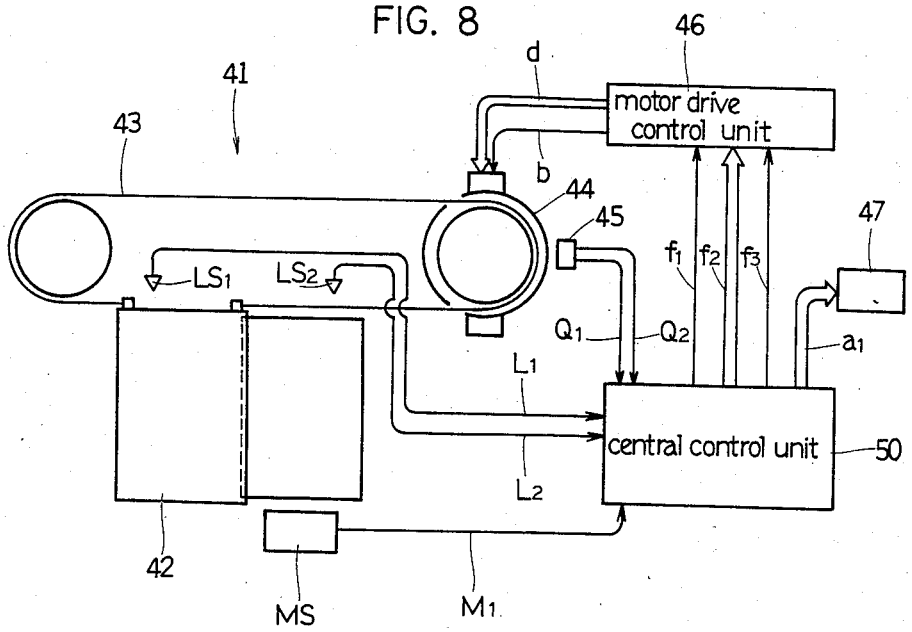
FIG. 8 is a descriptive drawing of an automatic door including a brake apparatus as a still other embodiment of the present invention.

In the automatic door 41 shown in FIG. 8, the door 42 is fixed to the belt 43 and is moved by the motor 44 through the belt 43.

Leftward transfer on the drawing is open direction of the door 42 and rightward transfer is close direction.

When the door 42 is between the position of a little before full open and the position of full open, the 1st limit switch LS1 is turned to ON. While the door 42 is between the position of a little before full shut and the position of full shut, the 2nd limit switch LS2 is turned to ON.

If the limit switch LS1 or LS2 is turned to ON, the door position signal L1 or L2 is turned to "1".

The mat switch MS gives the output of mat signal M1="1" when stepped on by a visitor.

The speed pulse signal output means 45 is to give output of speed pulse signal Q1 synchronizing with revolution of the motor 44, i.e. the output of speed pulse signal Q1 by every specified transfer of the door.

Accordingly, the time interval of the speed pulse signal Q1 is inversely proportional to transfer speed of the door 42.

With this auto-door equipment 41, the interval of adjacent speed pulse signals Q1 corresponds to 3 mm movement of the door 42.

The speed pulse signal output means 45 also provide output of speed pulse signal Q2. Basically, the speed pulse signal Q2 is basically similar to the above speed pulse signal Q1 but the phase is different.

While the motor 44 is turning in door open direction, loading edge of the pulse signal Q2 comes later than that of pulse signal Q1. When the motor 44 is turning in door shut direction, on the other hand, loading edge of Q2 comes earlier than that of Q1 and turns to "1".

The motor drive control unit 46 receives the motor turning direction signal f1 and speed signals f2 from the central control unit 50 and gives the output of motor drive signal d according to the received signals to operate the motor 44 at any operating mode, high-speed open (door speed V1), low-speed open (door speed V2), high-speed shut (door speed V3), low-speed shut (door speed V4), pressing (generation of faint pressing torque T in close direction), or free (torque O).

The automatic door 41 is set at V1=200 mm/sec., V2=67 mm/sec., V3=143 mm/sec., V4=45 mm/sec. and T=16 kg cm. Accordingly, the time interval of the speed pulse signal Q1 is 15 msec. at high-speed open, 45 msec. at low-speed open, 21 msec. at high-speed shut, and 63 msec. at low-speed shut.

Moreover, the motor drive control unit 46 also receives brake signal f3 from the central control unit 50 and gives the output of braking signal b based on the received brake signal to brake revolution of the motor 44.

The alarm 7 receives alarm signal a1 from the central control unit 50 and gives alarm to the operator by lamp flashing or buzzer sounding.

Figure 9:
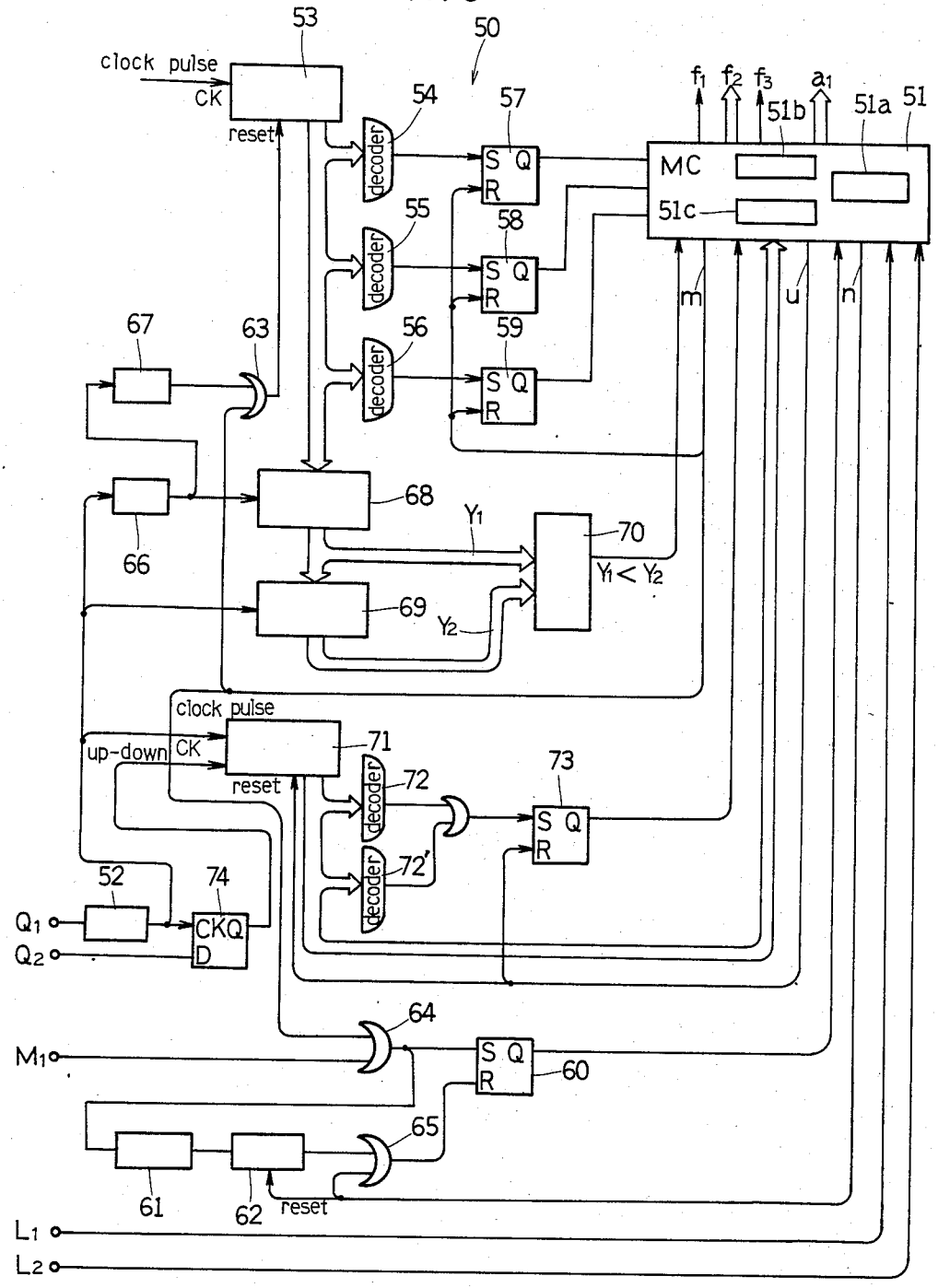
FIG. 9 is a circuit diagram of a central control unit included by the automatic door shown in FIG. 8.

FIG. 9 shows detailed circuit of the central control unit. In this circuit, the pulse interval detect means, to detect time interval of the speed pulse signa Q1 is composed of the leading edge one-shot circuit 52 into which the input of speed pulse signal Q1 is given and of the speed counter 53 into which the output of the leading edge one-shot circuit 52 is supplied through the delay circuits 66, 67, and the time interval of quotient which divides Q1 by clock cycle is the maximum output of the speed counter 53.

If the clock cycle is set at 1 msec., output of the maximum value from the speed counter 53 is "15" at high-speed open, "45" at low-speed open, "21" at high-speed close, and "63" at low-speed close.

By the decoders 53, 55 and 56, the flip-flops corresponding to each, i.e. low-speed open flag 57, low-speed close flag 58 and stop flag 59 are set at "1" while taking the output as "1" when the output of speed counter 53 reaches "45", "63" or "300" respectively.

These three sets of decoders and flags comprise the low-speed signal output means to detect low-speed open, low-speed shut, or practical stop of the door. In other words, the low-speed open flag 57 set at "1" means that the door speed is equal to or lower than the speed of low-speed open. Similary, low-speed close flag 58 set at "1" means that the door speed is equal to or lower than the speed of low-speed shut.

Setting of stop flag 59 at "1" means that the door speed is equal to or below 1.0 mm/sec. Door speed of normal transfer, however, can never be lower than 10 mm/sec., this means detection of stopping of the door 42.

As described later, the stop flag 59 also functions as the flag for abnormal low-speed detection and comprises the abnormal low-speed detection signal output means in combination with the microcomputer 51.

Output of the speed counter 53 is given into the current value latch 68 as the input, the output of the current value latch 68 is given into the previous value latch 69 as the input, the output signal of the leading edge one-shot circuit 52 is firstly applied to the previous value latch 69 as the latch input, then to the current value latch 68 slightly delayed by the delay circuit 66, then into the speed counter 53 as the reset input delayed further by the delay circuit 67. As the result, the current value latch 68 memorizes the maximum output value of the preceding speed counter 53, and the previous value latch 69 memorizes the maximum output of the speed counter 53 before that. In this sense, these latches 68, 69 comprise the interval time memorizing means.

The time interval memorizing means may also be composed of latch circuits, for example, or a part of the memory of the computer may be used.

The comparator 70 is to compare the output value Y1 of the current value latch 68 with the output value Y2 of the previous value latch 69, and to give "1" output when Y1 is smaller than Y2. This means that the interval time of the speed pulse signal Q1 is shortened i.e. speed of the door 2 is increased. As described later, the comparator 70 comprises the brake defective signal output means in combination with the microcomputer 21. The brake defect signal output means may be composed by hardware arrangement with the comparison circuit and gate circuit in combination but software arrangement with computers is also possible.

The break counter 71 is an up-down counter to count up the speed pulse signal Q1 when the output of the turning direction flag is "0". When the output of the turning direction flag 74 is "1" on the other hands, the break counter 71 counts down the speed pulse signal Q1.

As described before, as Q2 rises after the leading edge of Q1 when the motor 44 is turning in door open direction, the output of the turning direction flag 74 is set "0". When the motor 44 is turning in door close direction, on the other hand, as leading edge of Q2 rises earlier than that of Q1, the output of the turning direction flag 74 is set "1". In other words, the break counter 71 is a pulse counting means for counting up the speed pulse signal Q1 during the motor 44 revolutes in open direction and counting down during revolution of the motor 44 in close direction.

The decoders 72, 72' provide output when the output of the break counter 71 reaches the specified value which corresponds to each decoder and set the cut-off flag 73 to "1".

The specified value corresponding to the decoder 72 is set larger than the output value of the break counter 71 when the door 42 moves from full shut position to full open position. The specified value corresponding to the decoder 72' is set at the complement (which changes the code negative) of the specified value corresponding to the decoder 72.

If, for example, the stroke of the door 42 from full shut to full open is 3,000 mm and output of speed pulse signal Q1 is to be given at every 3 mm movement of the door 42, the count of the break counter 71 is "1000". Accordingly, specified value of the decoders 72, 72' are respectively set, for example, at "1200" and "−1200". The break counter 71 counts up at open transfer of the door and counts down at close transfer. In the above example, therefore, the output value is always kept within "−1000 to 1000". If the output reaches "−1200" or "1200", for example, it means that the motor 44 is turning with no regard to transfer of the door 42, and the cause is probably breaking off of the belt 43. The decoders 72, 72' and the break flag 73 comprise abnormal signal output means to give signal output at the occurrence of trouble with the belt such as break, as described above.

Generally speaking, the door speed should be lowered so long as the braking means are in normal operation and the interval time of the speed pulse signal should be prolonged. By comparing the interval time of the speed pulse signal, if interval time of the speed pulse signal is shortened or held equally in braking period, trouble of the braking means can be judged. The present braking equipment of this automatic door 41 is composed suitably to this judgement. Output value of the break counter 71 is given into the microcomputer 51 as the input, and the microcomputer 51 detects slipping of the belt 43 from the output value, as described later. In other words, the brake counter 71 and the microcomputer 51 comprise the abnormal signal output means for detecting belt slipping and giving signal output.

The visitor flag 60 is a flip-flop which is set at mat signal M1="1" and is reset through the trailing edge one-shot circuit 61 and delay circuit 62 after turning of mat signal M1 to "0", two seconds later for example.

The above mentioned speed counter 53 and flags 57, 58, 59, the break counter 71 and the break flag 73 are reset freely by the output pulse m and u of the microcoumputer 51. The visitor flag 60 is also set freely by the output pulse m. The visitor flag 60 and the delay circuit 62 are also reset freely by the output pulse n of the microcomputer 51.

The microcomputer 51 is the principal part of the automatic door equipment 41 and reads the door position signals L1, L2 besides the input and output of the above described peripheral circuits, and also gives output of motor turning direction signal f1, speed signal f2, and brake signal f3 to the motor drive control unit 46.

The microcomputer 51 also incorporates a trouble counter **51*a* to count the number of times of bothered closing operation of the door 42, a close register 51*c* to memorize the output of the break counter 71 at full shut position, and an open register 51*b* to memorize the output of the break counter 71 at full open position. It also provides alarm signal a1 to the alarm 47**.

Figure 10:
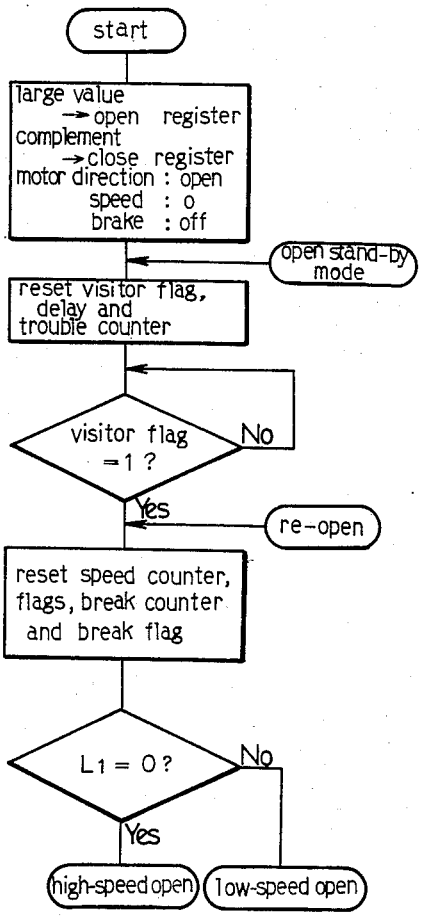
FIGS. 10*a*–10*n* comprise an operation flowchart.
Figure 10:
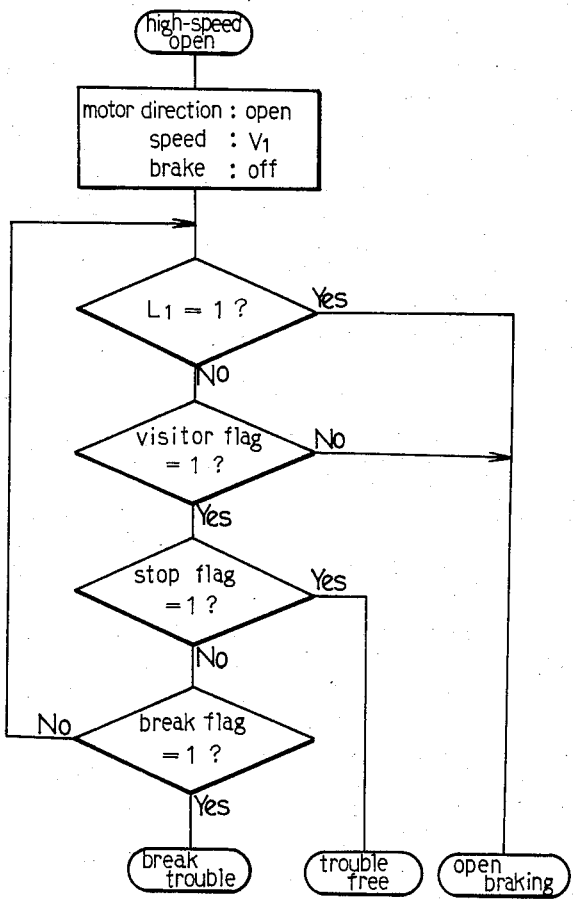
Figure 10:
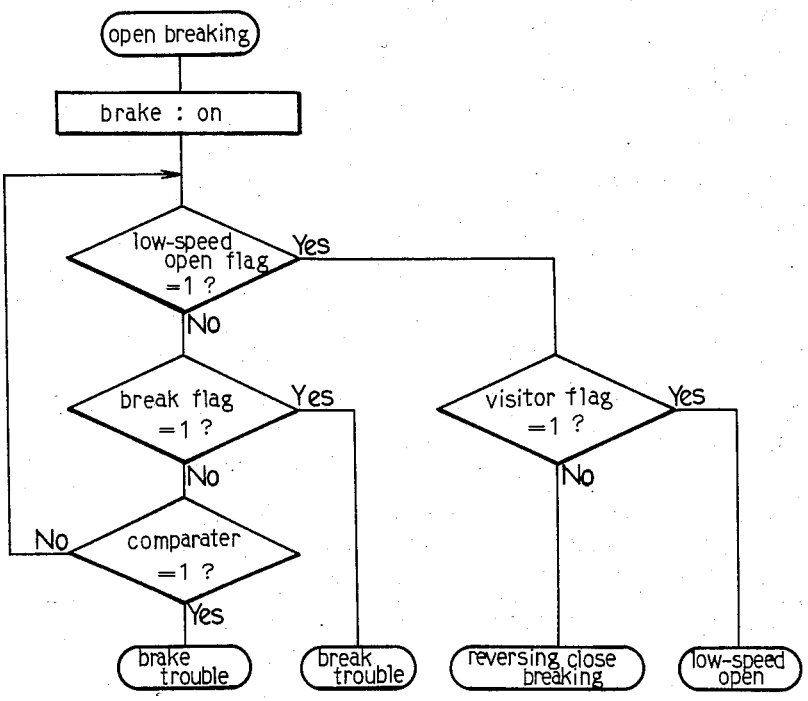
Figure 10:
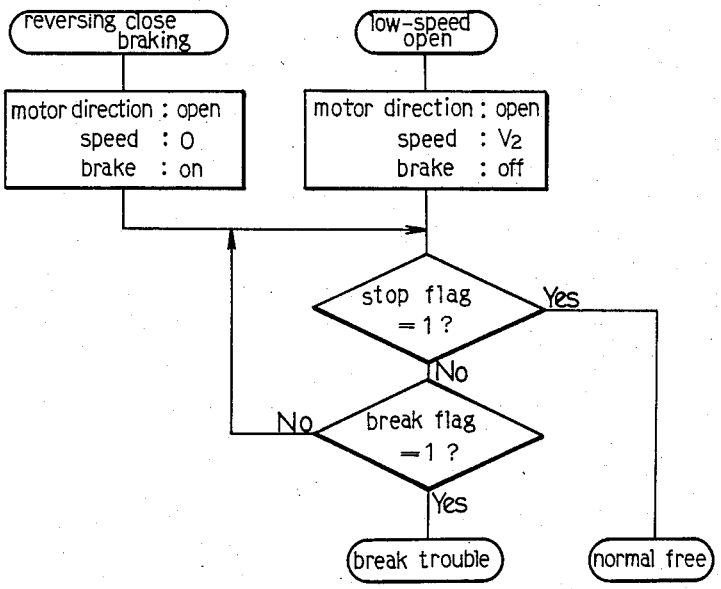
Figure 10:
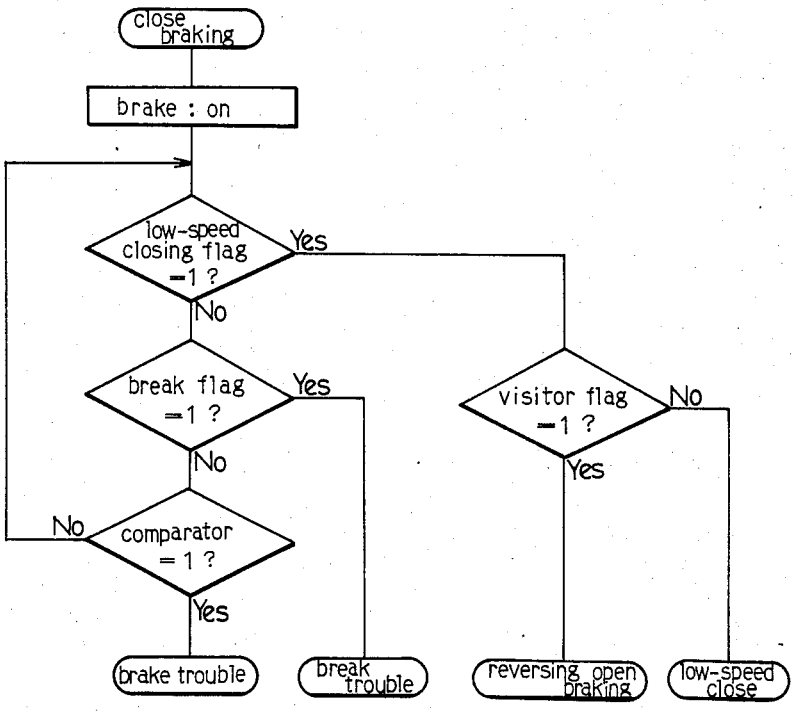
Figure 10:
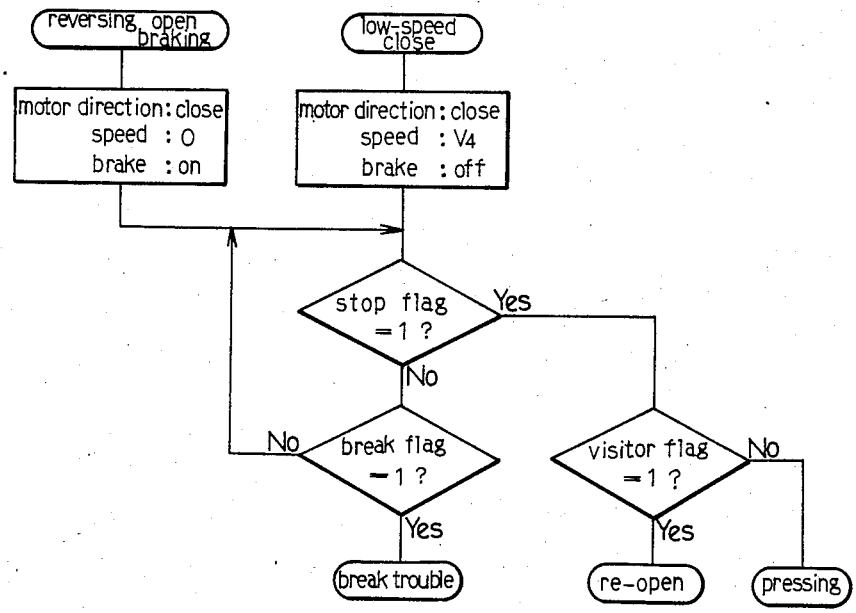
Figure 10K:
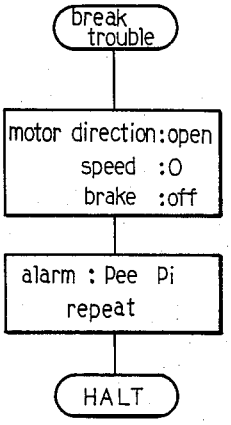
Figure 10K:
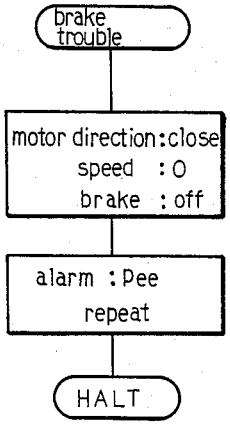
Figure 10M:
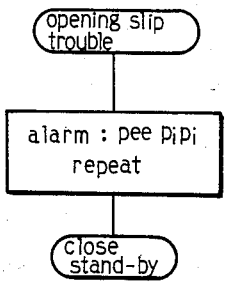
Figure 10N:
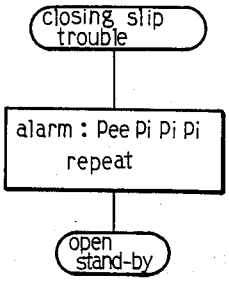

Referring now to FIG. 10, operation of the microcomputer 51 is described in the following text.

When operation of the automatic door 41 starts as shown in FIG. 10(*a*) from full shut position of the door 42 as the initial position, the microcomputer 51 set on the open register **51*b* a sufficiently large value, "2000" for example, and also set on the close register 51*c*** the complement "−2000", i.e. a sufficiently small value.

Then turning direction of the motor 44 is set at "open direction" by the signal f1, the speed is set at "0" by the signal f2, and the brake to "OFF" by the signal f3. Thus the door 42 is kept under free condition initially.

Then the visitor flag 60 and delay circuit 62 are reset by the output pulse n and the condition is kept waiting for setting of the visitor flag 60. When the mat switch MS is pressed by a visitor and the mat signal M1 turns to "1", the visitor flag 60 is set. When this is detected, the output signals m and u are transmitted. Then the speed counter 53, the flags 57, 58, 59, the break counter 71 and the break flag 73 are reset. At this time, the output signal m is also given into the OR gate 64. But any effection will not occur at all since the mat signal "M1" is "1".

After output of the output signal m, the door position signal L1 is read. If L1=0, the mode changes to high-speed open mode and if L1=1, the mode changes to low-speed open mode since the door 42 is already at a position closer to full open than the 1st limit switch LS1. As the door 42 starts from the full shut position initially, however, the mode is kept to high-speed open without fail.

As shown in FIG. 10(*b*), motor turning direction is in "Open direction", the speed is set to "V1" and the brake is set to "OFF" at high-speed open mode. Thus the door 42 starts open motion at V1 speed.

The high-speed open mode completes when opening of the door 42 to the lst limit switch LS1 is detected by L1=1, when two seconds elapse of no visitor on the mat switch MS is detected by "0" of the visitor flag 60, when the stop flag 59 is turned to "1", or when the break flag 73 is turned to "1".

In the first case, as open stroke of the door 42 is close to the end, and in the 2nd case, as there is no need to continue open motion since the visitor is no longer passing, it changes to open braking mode.

In the 3rd case, it is abnormal during high speed open mode to get over 10 mm/sec of door speed. So the microcomputer judge that some object is bothering the movement of door 42. Therefore the mode is turned to trouble free mode.

In the 4th case, the belt 43 is broken and the motor is judged idling. Accordingly, the mode changes to break trouble mode. As shown in FIG. 10(*c*), the brake is turned to on without changing condition of the motor 44 under open braking mode. The open braking mode completes on one of the three cases, low-speed open flag 57 turning to "1", break flag 73 turning to "1", or comparator 70 turning to "1".

In the first case, the brake is operated normally, accordingly the speed comes lowered. When the low-speed open flag 57 detects door speed reaches V2, visitor or no visitor is checked by the visitor flag 60. If there is a visitor, the mode changes to low-speed open mode and if no visitor stays, it changes to reversing close braking mode as there is no need to continue open motion any longer.

In the 2nd case, as the belt 43 is judged broken, the mode changes to break trouble mode.

The 3rd case means that speed of the door 42 is increased during the braking motion and this condition is judged that the brake is not operating normally. So it changes to brake trouble mode.

The braking operation is controlled in the following manner. The microcomputer 51 provides the brake signal f3 at the specified duty ratio, reads the output value of the break counter 71 under that situation, then read the output value of the break counter 71 again after certain period, compares the difference between the output values with the preset reference value. The duty ratio is increased if the said difference is larger than the reference value taking that the braking effect is smaller. If the difference is smaller than the reference value, on the other hand, the duty ratio is decreased judging that the braking effect is larger. Thus, braking effect is automatically adjusted to adequate level at all times even if the conditions are changing. Accordingly, smooth motion of the door 42 is ensured as desired.

At low-speed open mode, the motor 44 is so controlled that the brake is turned to "OFF" and the door 42 opens at V2 speed, as shown in FIG. 10(*d*).

Under the reversing close braking mode, on the other hand, the motor 44 is stopped and the brake is kept "ON". Under normal condition, therefore, transfer of the door 42 stops by opening stroke of the door 42 completes under low-speed open mode, and by of the brake under reversing close braking mode.

When this is detected by the stop flag 59, it changes to normal free mode. If the belt 43 is broken, however, the motor 44 keeps idling and the output of the break counter 71 increases, then the stop flag 59 does not turn to "1" but the break flag 74 turns to "1". At this time, the mode changes to break trouble.

Under normal free mode, the motor 44 is stopped, the brake is turned to OFF and the door 42 is set free, as shown in FIG. 10(*e*). Under this condition, as the door 42 has reached to the position of full open, the output of the break counter 71 shows the number of the speed pulse signal Q1, which corresponds to the full stroke of the door 42 from full shut position to full open position. Then the value on the break counter 71 is given as the input and is compared with previously memorized value into the open register 51*b*. If the input value is smaller, larger value by the specified difference than the input is set to the open register 51*b*. The specified difference can be determined from the allowable slip length of the belt 43. If, for example, the allowable slip length is 9 mm and output of speed pulse signal Q1 is given at every 3 mm transfer of the door 42, the specified difference is "3". If the input into the break counter 71 is "1000", therefore, "1003" is to be set into the open register 51*b*.

As the value memorized firstly in the open register 51*b* is sufficiently large, the initial input is always smaller than the initially memorized value. Accordingly, the 1st comparison between the memorized value in the open register 51*b* and the input value into the break counter 71 is meaningless. But from the 2nd time and on, the comparison becomes meaningful.

At the 2nd comparison, the previously memorized value in the open register 51*b*, "1003" for example, is compared with the value of the break counter 71. If the belt 43 has already slipped by more than 9 mm at this time, the value of the break counter 71 is over "1003", and the mode changes to opening slip trouble mode.

Slip trouble of the belt 43 can be detected in this manner through comparison of the value of the open register 51*b* with the value of the break counter 71.

If the belt is free from any slipping, the value of the open register 51*b* is renewed to a larger value by the specified difference than the input value into the break counter 71. While the visitor flag 60 is "1", as it means that a visitor stays on the mat switch MS, the door 42 is kept under free.

When visitor flag 60 detects that no visitor stays on the mat switch by turning to "0", the output pulses m, u, and n are provided in succession in the mentioned order, and the flags 57, 58, 59, 60, the speed counter 53, the break counter 71, the break flag 73 and the delay circuit 62 are reset.

Then the door position signal L2 is taken in. If L2=0, the mode changes to high-speed close, and if L2=1, the mode changes to low-speed closing since the door 42 is closed over the position of the 2nd limit switch LS2. In the initial stage, however, the mode is high-speed closing whenever since the door is opened to full open position for setting the open register 51*b*.

Under high-speed closing mode, the motor turning direction is "Closing", the speed is "V3", and the brake is "OFF", as shown in FIG. 10(*f*). Accordingly, the door 42 starts closing operation at V3 speed.

High-speed closing mode is put to an end in one of the following four cases; detection of the door 42 closed to the 2nd limit switch LS2 by L2=1, detection of the mat switch MS pressed by a visitor by the visitor flag 60 turning to "1", the stop flag 59 turning to "1", or the break flag 73 turning to "1".

In the 1st case, as the closing stroke of the door 42 is coming near to the end, and in the 2nd case, as the door is to be opened for a visitor coming, the mode changes to close braking mode. In the 3rd case, it isn't normal that the speed of the door 42 comes down below 10 mm/sec in the middle of high-speed closing mode. Transfer of the door 42 is bothered by some other object and the mode changes to trouble reversing mode. In the 4th case, the belt 43 is broken and the motor 44 is judged idling. Accordingly, the mode changes to break trouble mode.

Under close braking mode, the brake is turned to ON without changing condition of the motor 44 as shown in FIG. 10(*g*). Close braking mode is ended in one of the following three cases; when the low-speed closing flag 58 is turned to "1", when the brake flag 73 is turned to "1", or when the comparator 70 is turned to "1".

In the 1st case, brake operation is normal and door speed is lowered by braking. When door speed lowered to V4 is detected by the low-speed closing flag 58, any visitor or no visitor is checked by the visitor flag 60. If no visitor is there, the mode turns to low-speed closing mode. If any visitor stays, the mode changes to reversing open braking mode as it is necessary to open the door 42.

In the 2nd case, the belt 43 is judged broken and the mode changes to break trouble mode.

The 3rd case means that speed of the door 42 is increased during braking, and the brake operation is judged abnormal. Accordingly, the mode changes to brake trouble mode.

At low-speed close mode, the motor 44 is so controlled that the brake is turned to "OFF" and the door 42 is closed at V4 speed, as shown in FIG. 10(*h*).

Under reversing open braking mode, on the other hand, the motor 44 is stopped and brake "ON" is continued.

Under normal condition, therefore, door transfer is stopped because closing stroke of the door 42 comes to an end under low-speed closing mode or due to the brake under reverse open braking mode. When stopping of the door is detected by the stop flag 59, it is checked by the visitor flag 60 for any visitor or no visitor. If no visitor stays, the mode change to pressing mode. If any visitor is staying, it changes to the middle open mode shown in FIG. 3(*a*) in order to open the door 42 again.

If the belt 43 is broken, however, the motor 44 keeps idling, the output of the break counter 71 increases, the stop flag 59 does not turn to "1" and the break flag 73 turns to "1". Under this condition, it changes to break trouble mode.

Under the re open mode, the same operation is repeated as that of the detection of a visitor under start mode, and further description is omitted here.

Under the pressing mode, the motor turning direction is in "Open direction", the torque is "T", and the brake is "OFF" as shown in FIG. 10(*i*). Accordingly, the motor drive control unit 46 generates faint torque T in door closing direction on the motor 44 by lowering the supply voltage to the motor 44.

Because of the torque T, the door 42 is pressed against the door stop with a force which can be opened by hands and tightly closed condition of the door 42 is maintained.

Although the motor 44 can't be turned, there is no worry of burning due to over-heat because the supplied power is only to generate faint torque T.

Under this condition, the door 42 has reached to full shut position and the output of the break counter 71 indicates the number of the speed pulse signal Q1 corresponding to the full stroke of the door 42 from full open to full shut. The number, however, is negative for count-down and expressed as a complement.

Now the value of the break counter 71 is read, compared with the value previously memorized in the close register 51*c*, and the value smaller than the reading by a specific difference is set on the close register 51*c* if the reading value is smaller than the memorized value.

The specific difference can be determined from the allowable slip length of the belt 43. If the allowable slip length is 9 mm, and output of speed pulse signal Q1 is given at every 3 mm transfer of the door 42, for example, the specific value is "3". If the reading on the break counter 71 is "−1000", therefore, "−1003" is set on the close register 51*c*.

Since the value memorized initially in the close register 51*c* is small enough, as mentioned above, the initial reading value is always larger than the initially memorized value. The 1st comparison between the previously memorized value in the close register 51*c* and the read value of the break counter 71, therefore, is meaningless.

From the 2nd time and on, however, the comparison is meaningful. The previously memorized value in the close register 51*c*, "−1003" for example, is compared with the value of the break counter 71. If slipping of the belt 43 is more than 9 mm at this time, however, the value of the break counter 71 is lower than "−1003" and the mode changes to closing slip trouble mode.

Slip trouble of the belt 43 can be detected in this manner through comparison of the value of the close register 51*c* with the value of the break counter 71.

If the belt is free from any slipping, the value of the close register 51*c* is renewed to a value smaller than the input value into the break counter 71 by the specific difference, and the mode changes to open stand-by mode as shown in FIG. 1(*a*).

The open stand-by mode is the same as the operation waiting for visitors under start mode, and further description is therefore omitted.

FIG. 10(*j*) shows processing under trouble free mode and trouble reverse mode.

At trouble free mode, the motor turning direction is in "open direction", the speed is "0", and the brake is "OFF", and the door 42 is kept in free condition. Then the output of alarm signal a1 is given and alarm sound is transmitted from the alarm 47 intermittently and repeatedly. The condition is kept to resetting of the visitor flag 60.

When the flag 60 is reset, the mode changes to the open stand-by shown in FIG. 10(*a*). This is to keep visitors off the mat switch MS for safety at a trouble.

Under trouble reverse mode, on the other hand, the trouble counter 51*a* is subjected to increment. If the number of times of trouble is less than the specified number of times, three times for example, output of pulse m is given, and the mode changes to the middle open mode shown in FIG. 10(*a*). The door 42 is reversed by this to open operation.

Since the output pulse m is instantaneous, the door 42 is turned to close operation again after the delay time in the delay circuit 62. If the cause of trouble is not removed at this time, however, it turns to trouble reverse mode again and the same operation is repeated.

When the repetition reaches the specified number of times, it changes to trouble free mode as further repetition of open-close operation is meaningless. In other words, the door 42 is kept in free condition after repeating trouble reversing by the specified number of times.

If the cause of trouble is removed before the specified number of times is reached, the door 42 turns to open stand-by mode of FIG. 10(*a*) after the normal closing operation, and the trouble counter 51*a* is reset to normal stand by condition of the initial stage.

FIG. 10(*k*) shows processing of the break trouble mode, in which the motor 44 is stopped immediately, and the brake is turned to "OFF". Then output of alarm signal a1 is given, the alarm 47 transmits alarm sound repeatedly and intermittently, and operation of the automatic door 41 is stopped under this condition.

FIG. 10(*l*) shows processing of brake trouble mode, in which the motor 44 is stopped immediately, and the brake is turned to "OFF". Then output of alarm signal a1 is given, the alarm 47 transmits alarm sound repeatedly and intermittently, and operation of the automatic door 41 is stopped under this condition.

FIG. 10(*m*) shows processing of opening slip trouble mode. Although, the alarm sound of specific pattern is transmitted for the specified time, mode turns to the close stand-by mode shown in FIG. 10(*e*) as there is no need to stop operation of the automatic door 41.

FIG. 10(*n*) shows processing of closing slip trouble mode. Although, the alarm sound of another specific pattern is transmitted for the specified time, mode turns to the open stand-by mode shown in FIG. 10(*a*) as there is no need to stop operation of the automatic door 41.

As described above, this automatic door 41 detects break of the belt 43, stops operation, and transmits alarm. Slipping of the belt 43 is also detected at an early stage and alarm is transmitted. The operator can guess the cause of trouble easily since the alarm transmission is made in specific pattern depending on each cause of trouble.

As the alarm means, lamp, buzzer, and CRT display may be used, for example. The alarm which can identify and notify brake defect is preferable, in particular.

Other embodiments may include the arrangement to judge door position from speed pulse signal so as to eliminate door position sensors LS1, LS2, may include infrared ray type sensors or radar type sensors in place of the mat switch MS, or may include the arrangement to comprise the central control unit 50 with hardware circuits without using the microcomputer 51.

After all, by the brake apparatus of the above described automatic door 41, alarm is issued immediately at malfunction of the brake, which enables countermeasures at earlier stage and serves to improve reliability of the automatic door.

This invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

We claim:

1. A brake apparatus for automatic door comprising:

(a) speed pulse signal output means for providing speed pulse signals at an interval time inversely proportional to door speed of an automatic door; (b) braking means for lowering the door speed; (c) braking position detecting means for detecting the braking position where said braking means starts breaking; (d) brake effect measuring means for measuring the effect of said braking means; (e) brake defective signal output means for detecting maloperation of the braking means based on the measured brake effect and for providing a brake defective signal; and (f) alarm means for providing alarm at output of said brake defective signal.

2. A brake apparatus for automatic door comprising:

(a) speed pulse signal output means for providing speed pulse signals at an interval time inversely proportional to door speed of an automatic door; (b) brake effect measuring means including, (1) pulse interval detecting means for detecting an interval time of said speed pulse signals, (2) interval time memorizing means for memorizing the interval time detected by said pulse interval detecting means; and (3) comparing means for comparing the interval time of the pulse signals obtained at certain time with the interval time of the pulse signal memorized previously during the period of braking operation; (c) brake defective signal output means for providing a brake defective signal when the interval of pulse signals obtained at certain time is smaller than or equal to the interval time of the pulse signal memorized beforehand; and (d) alarm means for providing alarm at output of said brake defective signal.

* * * * *